United States Patent [19]

Garcea et al.

[11] 4,421,074

[45] Dec. 20, 1983

[54] AUTOMATIC TIMING VARIATOR FOR AN INTERNAL COMBUSTION ENGINE

[75] Inventors: Giampaolo Garcea; Ambrogio Banfi, both of Milan; Michele L. Di Stefano, Limbiate, all of Italy

[73] Assignee: Alfa Romeo S.p.A., Milan, Italy

[21] Appl. No.: 285,614

[22] Filed: Jul. 21, 1981

[30] Foreign Application Priority Data

Jul. 31, 1980 [IT] Italy ..... 23841 A/80

[51] Int. Cl.[3] ..... F01L 1/34

[52] U.S. Cl. ..... 123/90.15; 464/2

[58] Field of Search ..... 123/90.15, 90.17, 355, 123/357, 500, 501, 502, 503; 137/56; 464/2

[56] References Cited

U.S. PATENT DOCUMENTS

| | | | |
|---|---|---|---|
| 2,378,158 | 6/1945 | Roche | 137/56 |
| 3,004,410 | 10/1961 | Pierce | 464/2 |
| 3,258,937 | 7/1966 | Kranc et al. | 123/90.15 |
| 4,231,330 | 11/1980 | Garcea | 123/90.15 |
| 4,305,367 | 12/1981 | Imasato et al. | 464/2 |

*Primary Examiner*—Craig R. Feinberg
*Assistant Examiner*—W. R. Wolfe
*Attorney, Agent, or Firm*—Charles E. Brown

[57] ABSTRACT

This invention relates to a timing variator device for an internal combustion engine, comprising a coupling between the cam shaft and the drive gear, which is capable of making angular movements between the coupled parts according to the rotational speed, and in which said movement is actuated by the engine lubricating oil under the control of a valve element constituting the member sensitive to the engine speed.

3 Claims, 5 Drawing Figures

AUTOMATIC TIMING VARIATOR FOR AN INTERNAL COMBUSTION ENGINE

It is well known that only in the case of ideal operation of four-stroke internal combustion reciprocating engines does the opening and closure of the intake and exhaust valves take place at the dead centres, i.e. in the precise angular position of the crankshaft for which the piston is in one of its two limiting positions.

In practical engines, this ideal simultaneous relationship is not maintained in order to take account of many well known factors, such as the gas inertia or the acceleration allowable in said valves as they move between their closed and open position and vice versa.

The timing adjustment between the drive shaft and camshaft which controls the valves is generally prechosen in order to optimise efficiency for a determined engine speed, but can be inadequate for other speeds.

Timing variators between the camshaft and drive shaft have therefore been proposed for varying the timing as the engine rotational speed varies.

It would be generally desirable in a motor vehicle engine that the timing, as defined by a group of opening advance and closure delay angles of the valves relative to the piston dead centres, should vary continuously as a function both of the rotational speed and of the degree of throttle. However it is obvious that a device to attain this continuous timing variation would be excessively complicated.

It has for example been proposed in the previous patent in U.S. Pat. No. 4,231,330 in the name of the same applicant, to provide a timing variator able to accomplish two timing values, these being for rotational speeds which are respectively higher and lower than a predetermined value.

It has now been found that further advantages can be attained by providing a variator, usable in the case in which the engine is provided with two separate camshafts (one for controlling the intake valves and one for controlling the exhaust valves), and which although being of little complexity and entirely reliable, enables two different timings to be attained. In addition, as the engine rotational speed varies, it provides automatic passage from a first timing suitable for operation below a rotational speed n1 and a second suitable for operation at rotational speeds between said rotational speed n1 and a rotational speed n2, and to return to the first timing at rotational speeds above n2. Because of the complexity of the various inertia phenomena mentioned heretofore, and connected with the times available for transferring the fluid through the valves, it often happens in this respect that the ideal timing at very low rotational speeds (with the considerable throttling typical of use at these speeds) is not much different from the ideal timing at much higher rotational speeds (which are used for maximum performance, and thus with the throttle very open or at full throttle). The first aforesaid timing is therefore an intermediate timing between the two ideal timings, to which it is sufficiently close.

An essential characteristic of the variator is that relative to operational precision. In this respect, each of the two said timings corresponds to one of the two limiting positions of a mobile drive member, and the limit stops can be constructed with great accuracy without difficulty. If the timing remains unchanged, then in each of the said three zones into which the field of operation is divided (in relation to the rotational speed), the other adjustment parameters can be optimised (e.g. mixture ratio, ignition advance, amount of exhaust gas recirculation (EGR), etc.) to give uniformity of engine operation and to minimise fuel consumption and emission.

The said mobile drive member forms part of the transmission linkage between the camshaft and drive shaft, with which it is engaged by means of splined couplings, of which at least one is of helical toothed type, and its axial movements which cause the camshaft to rotate relative to the drive shaft occur automatically as soon as one of the two opposing forces acting on it, namely the preloading of a spring and the pressure of the engine lubricating oil, exceeds the other. Said pressure either acts on the drive member or not, depending upon whether an oil vent port is closed or open. This port is controlled by a valve provided with a valve element of the slide type, which automatically assumes three different positions, one for each of the said three zones into which the field of operation of the engine is divided by said two predetermined speeds of rotation, n1 and n2. In this respect, said valve is connected to the camshaft, and thus rotates therewith, and a mass which is rigid with the slide valve element and has its centre of gravity displaced from the camshaft axis tends to move the valve element relative to its seat by the effect of the centrifugal force. The preload F1 of a first small return spring prevents this movement while the centrifugal force is lower than that corresponding to the rotational speed n1, and thus below the rotational speed n1 the slide valve element is at rest in the first of its said three different positions. Above this rotational speed, the centrifugal force overcomes the preload F1 to move the valve element into the second of the three said positions. The preload F2 of a second small return spring prevents further movement while the centrifugal force is lower than that corresponding to the rotational speed n2, and thus the valve element is at rest in the second position for all engine rotational speeds lying between n1 and n2. Above the rotational speed n2, the centrifugal force overcomes the preload F2, and the slide valve element is moved into a third position defined by a limit stop, and remains there for all rotational speeds exceeding n2.

According to a preferred embodiment of the variator, when in its first position below the rotational speed n1, the valve element keeps an oil pressure vent port open. Thus, only the preload of a return spring acts on said drive member of the device to hold it against the first of said limit stops so as to obtain the first of the said two timings of the camshaft with respect to the engine. When the rotational speed exceeds the value n1, the valve element in its second position closes the oil vent port. The pressure of the lubrication circuit acts on the drive member to overcome the preload of the return spring. The drive member is therefore moved and held in contact with the second of its said limit stops, so as to cause the camshaft to rotate relative to the drive shaft and attain the second of the two timings of the camshaft with respect to the engine. Above the engine rotational speed n2, the valve element is moved into and kept in its third position by the centrifugal force originated by sid eccentric mass. In this position, the valve element keeps the oil vent port open as in the first position. Thus, in the absence of oil pressure and by the effect of the spring, the drive member is moved and held against the first of its two limit stops, so that at rotational speeds exceeding n2, the first of the two timings of the camshaft with respect to the drive shaft is again attained, i.e. the same timing as for rotational speeds less than n1.

As stated heretofore, due to the fact that each of the two timings is determined by the positioning of the drive member in contact with one of the two limit stops, the requirement of accurate timing is satisfied, so that said valve opening advance and closure delay angles assume the precise predetermined values. However, for uniformity of engine operation (and also to optimise performance by minimising fuel consumption and emission), the requirement of accuracy relative to the speed of transition from one timing to another must also be satisfied. For this purpose, in the variator according to the present patent application, the design of the valve and valve element is such that only the aforesaid two opposing forces act on the valve element, and the direction of said forces coincides with the direction of movement of the valve element. There are therefore no forces or components in a direction normal to the movement of the valve element which, by acting on the valve element, give rise to loads normal to the cylindrical contact and guide surfaces between the valve element and seat in the valve body. As these loads are zero, there is no friction which, opposing movement, could give rise to inaccuracy in the values of the rotational speeds of transition from one timing to another.

In other words, the resultant of the oil pressures acting on the valve element surface is zero, and the valve element is balanced, because the inlet port for the pressurised oil is always in communication with an annular groove thereof arranged to convey the oil towards the vent ports, even when the valve element is in the position in which said vent ports are closed. The action of the pressurised oil is therefore exerted along the entire circumference of the valve element, with force equilibrium.

The aforesaid will be more apparent from the description given hereinafter with the aid of the accompanying FIGS. 1 to 5 which show a preferred embodiment of the variator by way of non-limiting example, and in which.

Figure 1:
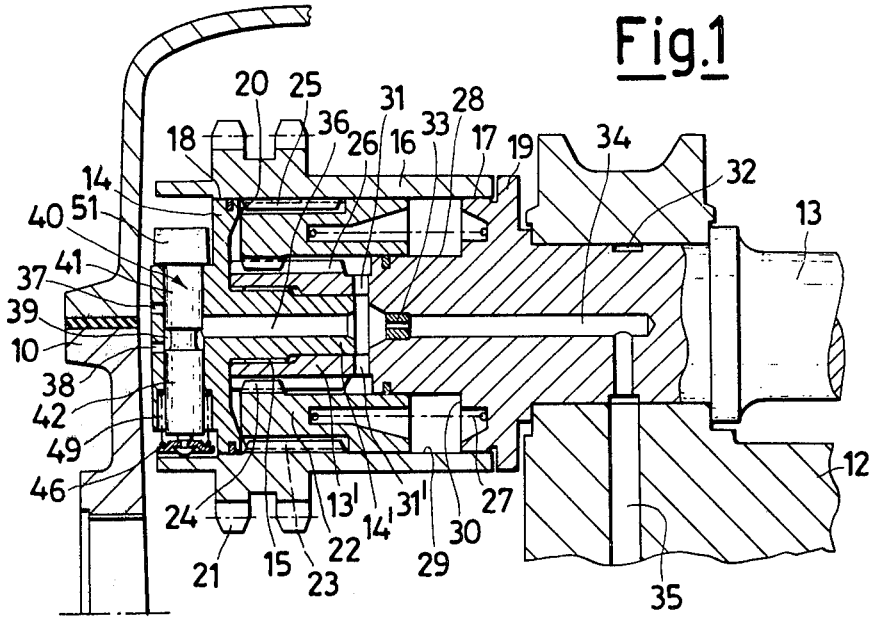
FIG. 1 is a section through the variator according to the invention, on a plane passing through the axis of the camshaft.

FIG. 1 shows the end part of a camshaft which is controlled from the drive shaft for example by means of a chain. The reference numeral 10 indicates a wall of the head, and 12 that part of the head in which the end support is formed for the corresponding pin of the camshaft 13. The end disc 14 is connected to the camshaft 13 by being screwed at 15 by means of its cylindrical extension 14' to the corresponding cylindrical extension 13' of the shaft 13. The cylindrical sleeve 16 coaxial to the camshaft is rotatably supported at its ends at the cylindrical surface 17 of the camshaft and at the cylindrical surface 18 of the disc 14. Any axial sliding of the sleeve 16 relative to the shaft 13 and element 14 are prevented by the ledge 19 on the shaft 3 and by the ledge 20 on the disc 14 which grazes the end of the internal toothing 25 rigid with the sleeve 16. The reference numeral 21 indicates the external toothing rigid with the sleeve 16 with which there engages the chain, not shown in the figure, which connects the sleeve to the engine crankshaft (not shown in the figure). Said inner toothing of the sleeve 16 engages with the outer toothing 23 of the annular piston 22, which is also provided with inner toothing 24, this latter toothing 24 engaging with outer toothing 26 on the camshaft 13. At least one of the two pairs of toothing engaged with each other (24, 26; 23, 25) is helical. One toothing of the two pairs also extends axially much more than the other. As a result, the piston 22 is mobile in the annular cavity defined by the sleeve 16, disc 14 and camshaft 13, and as the two pairs of toothing always remain engaged with each other, as the annular piston 22 slides axially relative to the camshaft 13, disc 14 and sleeve 16, the camshaft rotates relative to the sleeve 16 and thus also relative to the crankshaft which is connected to the sleeve 16 by means of the chain. The extent of this rotation, i.e. this variation in the timing of the crankshaft relative to the drive shaft, depends on the extent of the axial movement of the annular piston 22 relative to the camshaft and on the inclination of the helical toothing (or toothings). The two pairs of toothing are constructed in such a manner as not to hinder the flow of oil, either by means of a suitable gap between the teeth or even by removing one or more teeth. In FIG. 1, the annular piston 22 is shown in one of its two limiting positions, and is kept in contact with the said ledge 20 of the end disc 14 by the preloading of the spring 27. the said annular piston 22 is characterised by the fact that at the other end to that comprising the inner and outer toothing, two gauged cylindrical surfaces, an inner and an outer one, adhere to corresponding gauged cylindrical surfaces, one of which is an outer surface on the shaft 13 and indicated by 28, and the other of which is an inner surface on the sleeve 16 and indicated by 29. The radial slack between the cylindrical surfaces which adhere together is very small, so that the possibility of oil seepage between the said cylindrical surfaces is also very small, even if the oil is under pressure. A hydraulic pressure can act on that annular surface of the piston 22 normal to the axis and opposing that on which the spring 27 acts, having a value such as to overcome the preload of the spring 27, so that the piston is urged in the direction opposing the action of the spring until it adheres to the ledge 30 of the shaft 13, which defines the second limiting position of the piston 22. The pressurised oil can reach the piston through the bores 31 and 31' and through the restricted port 33, from the duct 34 provided in the shaft 13. The oil reaches the duct 34 from the annular cavity 32 and from the duct 35 formed in the head 12, which carries the lubricating oil to the support formed in the head 12 for the shaft 13. The duct 36 formed in the cylindrical extension 14' can be connected to the interior of the engine head through the pairs of ducts 37 and 38 (better seen in FIG. 5) when one or the other is in a position corresponding with the annular groove 39 in the valve element 40 of the slide valve provided in the end disc 14.

Figure 4:
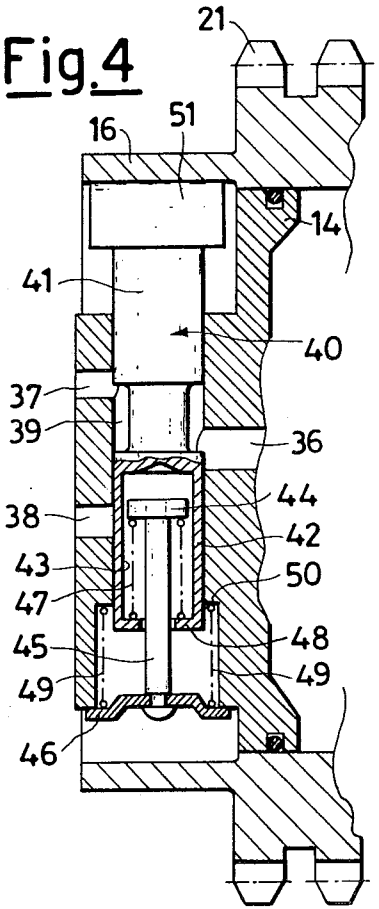
FIGS. 2 to 4 are enlarged views of the slide valve of FIG. 1 in its three adjustment positions.
Figure 3:
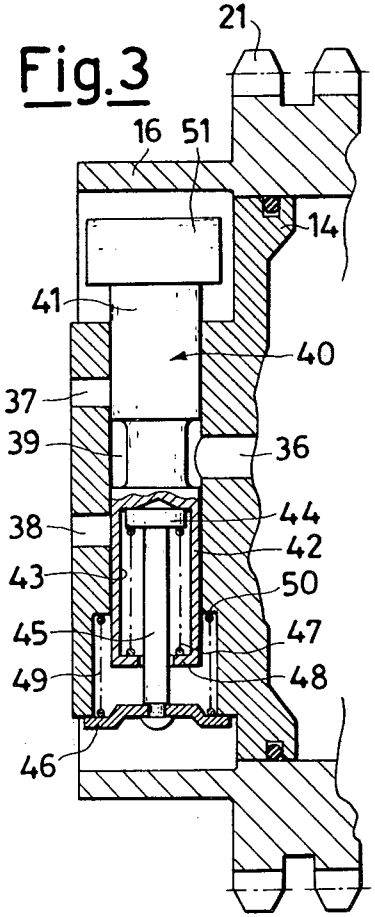
Figure 2:
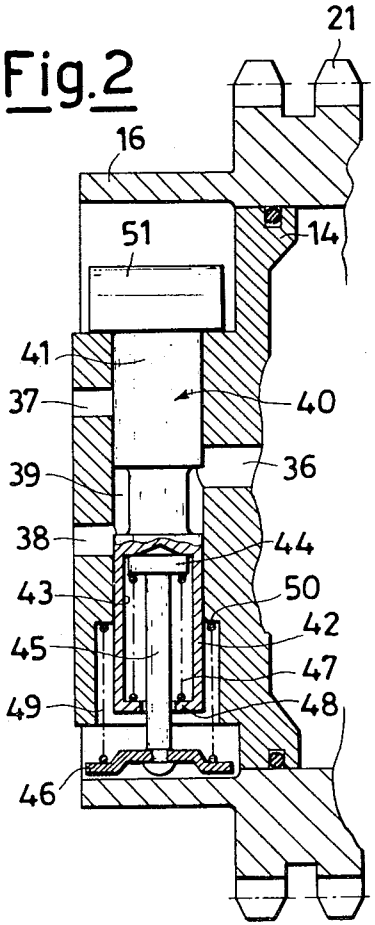

As can be easily seen in FIGS. 2–4, the valve element comprises two cylindrical portions 41 and 42 separated from said annular groove 39, and the cylindrical portion 41 comprises an inner cavity 43 in which the cap 44 is slidably housed, its stem 45 being fixed to the cap 46. The reference numeral 47 indicates a first spring disposed between the cap 44 and the annular ledge 48 rigid with the wall of the cylindrical portion 42. The reference numeral 49 indicates a second spring, more flexible than the first, disposed between the cap 46 and a stop ledge 50 provided in the disc 14.

The mass 51 is rigid with the valve element 40 in a position eccentric to the axis of the camshaft 13, and thus by virtue of centrifugal acceleration is able to exert on the valve element an outwardly directed force which increases as the speed of rotation of said camshaft increases.

During the engine operation, the valve element 40 remains in the position of FIG. 2 until the centrifugal force to which the eccentric mass 51 is subjected exceeds the preload of the two springs 47 and 49. In this situation, the valve element 40 is in its first adjustment position, in which the annular groove 39 puts the duct 36 into communication with the vent 38, so discharging the pressurised oil arriving from the duct 35 in the head. Consequently, the piston 22 is thrust by the spring 27 into its first limiting position against the wall 20 (as shown in FIG. 1), and sets a first timing position for the camshaft 13 relative to the sleeve 16 and thus relative to the drive shaft.

When the rotational speed of the camshaft 13 exceeds the value n1, the centrifugal force due to the eccentric mass 51 exceeds the preload of the spring 47, to move the valve element 40 towards the outside of the disc 14 (as shown in FIG. 3). In this case, the valve element 40 becomes located in its second adjustment position, with the annular groove 39 in communication with the duct 36, but with the cylindrical portions 41 and 42 facing the vents 37 and 38, which thus remain blocked.

As the oil from the duct 25 is prevented from discharging, it remains under pressure and exerts a force on that annular wall of the piston 22 opposite that on which the spring 27 acts, which is able to oppose the load of the spring 27 and to move the piston 22 into its second limiting position against the wall 30. The movement of the piston 22 causes a rotation of the camshaft 13 relative to the sleeve 16 and thus relative to the drive shaft, so that said camshaft assumes a second timing position relative to said drive shaft.

Finally, when the rotational speed of the camshaft exceeds the value n2 (greater than n1), the centrifugal force due to the eccentric mass 51 also overcomes the preload of the spring 49, to further move the valve element 40 towards the outside of the disc 14 until it abuts against the wall of the sleeve 16 (as shown in FIG. 3). The valve element 40 thus lies in its third adjustment position, with the annular groove 39 connecting the duct 36 to the vent 37, through which the oil from the duct 25 is discharged. In this situation the spring 27, which is no longer opposed by the oil pressure, again thrusts the piston 22 into its limiting position with a consequent counter-rotation of the camshaft 13, which returns to the condition in which it assumes a timing position identical with the first one indicated heretofore.

From FIGS. 2–4 it can be seen that the valve element 40 is balanced and is not subjected to forces transverse to its axis because its annular groove 39 is always in communication with the oil feed duct 36, even when the valve element closes the vent ports 37 and 38 (see FIG. 3), so that the oil pressure is exerted along its entire circumference with balancing of the consequent radial forces.

Figure 5:
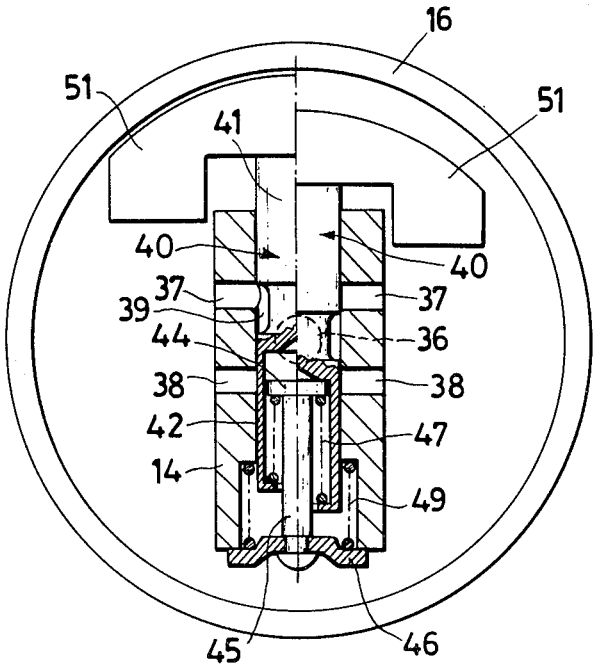
FIG. 5 is a front view of the slide valve of the variator, shown in two adjustment positions.

FIG. 5 shows the valve element 40 and eccentric mass 51 in two adjustment positions, namely the third adjustment position on the left and the second adjustment position on the right.

We claim:

1. A timing variator for an internal combustion engine especially for motor vehicles, said internal combustion engine including intake valves, exhaust valves, two camshafts, a crankshaft, a lubricating circuit, said intake valves being controlled by one of said camshafts and said exhaust valves being controlled by the other of said camshafts, both of said camshafts being provided with a gear for their driving by said engine crankshaft and for in the connection to the relative gear being made by means of a mobile drive member constituted by an annular piston seated in a cavity and provided with a first and second splined coupling, said first splined coupling being engaged with a spline provided on said gear, said second splined coupling being engaged with a spline provided on said one camshaft, at least one of said splines of said two couplings having a helical extension, said one camshaft having an axis and said annular piston being able to undergo axial sliding in the direction of said camshaft axis, said sliding being limited by two limit stop surfaces disposed in an annular cavity between said one camshaft and said gear, said annular piston being urged into and maintained in a first of its two limiting positions by a piston spring having a preload, said cavity in which said piston is housed being in communication by way of a bore of predetermined size with said engine lubricating oil circuit, said cavity being in selective communication with the outside by way of a shut-off slide valve, said shut-off slide valve having a slide valve element which by moving in a direction normal to said camshaft axis can move from a first adjustment position to a second adjustment postion and to a third adjustment position, said slide valve element being rigid with a mass which is eccentric to said camshaft axis, a first small spring and a second small spring each having a preload acting on said slide valve element in its sliding direction so as to urge it into its said first position if the rotational speed of the engine is less than a value n1 at which a centrifugal force due to an eccentric mass carried by said one camshaft balances the preload of said first small spring, whereas at rotational speeds greater than n1 but less than a value n2 which exceeds n1 said centrifugal force exceeds the preload of said first small spring so as to move said slide valve element into its said second position, and furthermore at rotational speeds greater than n2 said centrifugal force also exceeds the preload of said second small spring so as to move said slide valve element into said third position, said slide valve element putting said annular cavity into communication with the outside when in its first adjustment position and when in its third adjustment position, whereas it shuts off the communication between said annular cavity and the outside when in its second adjustment position so as to cause oil under pressure to flow into said cavity in the absence of oil under pressure in said cavity said annular piston being maintained by said piston spring in said first of its two limiting positions whereas when there is oil under pressure in said cavity this oil moves said annular piston into and maintains it in the second of said piston two limiting positions, so that by the effect of said spline helical extension on the annular piston, a first determined timing of said one camshaft relative to said crankshaft is attained at rotational speeds less than said value n1, whereas at rotational speeds greater than n1 and less than n2 a second determined timing is attained, and at rotational speeds exceeding n2 the first timing is again attained.

2. A timing variator as claimed in claim 1, characterised in that said slide valve element of said shut-off slide valve is provided with two cylindrical portions separated by an annular groove, one of said cylindrical portions comprising an inner cavity in which there is slidably guided a first cap connected by a stem to a second cap, said first small spring being disposed between said first cap and an inner ledge on a wall of that one of said cylindrical portions which houses it, said shut-off slide valve having a body, said second small spring, of lower rigidity than said first small spring, being disposed between said second cap and a ledge on said body of said shut-off slide valve.

3. A timing variator as claimed in claim 2, characterised in that said annular groove is arranged to put said lubricating oil circuit into communication with vent ports when said slide valve element is in said first and third adjustment positions, said annular groove also being in communication with said lubricating oil circuit when said slide valve element is in its second adjustment position, in which said vent ports are closed.

* * * * *

UNITED STATES PATENT AND TRADEMARK OFFICE

CERTIFICATE OF CORRECTION

PATENT NO. : 4,421,074

DATED : December 20, 1983

INVENTOR(S) : Giampaolo Garcea et al

It is certified that error appears in the above-identified patent and that said Letters Patent is hereby corrected as shown below:

Column 2, line 62, change "sid" to read -- said --.

Column 4, line 27, change "the" to read -- The --.

Column 6, line 10, cancel "in" and insert -- their appropriate timing relative to said crankshaft, in the case of at least one of said camshafts --;

Column 6, line 13, before "second" insert -- a --.

Signed and Sealed this

*Twelfth* Day of *March 1985*

[SEAL]

*Attest:*

DONALD J. QUIGG

*Attesting Officer*

*Acting Commissioner of Patents and Trademarks*